United States Patent [19]

Di Pasqua

[11] 4,165,754

[45] Aug. 28, 1979

[54] HAIR-FROSTING CAP

[76] Inventor: Joseph Di Pasqua, 2586 Sulphur Spring Rd., Sauquoit, N.Y. 13456

[21] Appl. No.: 811,703

[22] Filed: Jun. 30, 1977

[51] Int. Cl.[2] ..... A45D 19/18

[52] U.S. Cl. ..... 132/9

[58] Field of Search ..... 132/9, 36, 46, 48; 2/174, 2; 24/257

[56] References Cited

U.S. PATENT DOCUMENTS

| | | | |
|---|---|---|---|
| 2,125,622 | 8/1938 | Bleuel et al. | 132/36 |
| 3,304,945 | 2/1967 | Anderson | 132/9 |

*Primary Examiner*—G. E. McNeill

*Attorney, Agent, or Firm*—Clarence A. O'Brien; Harvey B. Jacobson

[57] ABSTRACT

A hair-treating cap for covering a scalp during hair frosting and similar treatments has a head covering which completely covers the scalp of a wearer whose hair is being treated, and over the surface of which covering is provided a plurality of clamps for holding a lock of hair to be treated while preventing treating solution from reaching hair and the scal beneath the head covering. The clamps, which include a rotating lock member for positively gripping the hair, either can be made integral with the head covering or as a separate element sealed into openings provided in the head covering.

11 Claims, 9 Drawing Figures

HAIR-FROSTING CAP

BACKGROUND OF THE INVENTION

1. Field of the Invention

This invention relates generally to appliances for use with hair treatment procedures, and particularly to a head covering which facilitates hair frosting and like operations.

2. Description of the Prior Art

It has become rather popular especially in the area of women's fashions to create special effects in one's hair. Among these effects are frosting, tipping, streaking, high-lighting, haloing, and the like. A difficulty encountered in creating these special effects is that care must be taken to prevent the bleach or other suitable solution being used on the locks of hair being treated from bleeding back toward the scalp and reaching hair which is not desired to be treated. For this reason, it has been found somewhat impractical to treat certain shades of natural hair coloring, because of the difficulty in controlling the various operations involved.

Various caps, examples of which can be found in U.S. Pat. Nos. 3,249,113, issued May 3, 1966, to T. J. Sobeck; 3,304,945, issued Feb. 21, 1967, to G. W. Anderson; and 3,468,318, issued Sept. 23, 1969, to L. Cook, et al., have been proposed for facilitating hair treating operations as discussed above. More specifically, the aforementioned prior patents disclose perforated caps to be used in frosting, tipping, and similar operations, which caps are intended to protect the scalp and hair not to be treated by permitting the hair to be treated to be pulled through the perforations provided in the cap. In particular, U.S. Pat. Nos. 3,304,945 and 3,468,318 disclose the use of locking devices in conjunction with the caps, which devices firmly hold in place the locks of hair passed through the perforations provided in the associated cap.

U.S. Pat. Nos. 2,125,622, issued Aug. 2, 1938, to W. H. Bleuel, et al., and 2,618,274, issued Nov. 18, 1952, to E. L. Nell, disclose examples of perforated scalp-protecting caps employed in hair waving and setting operations. These protective caps employ hair gripping devices generally referred to as "curlers" for facilitating the curling and waving of the hair.

SUMMARY OF THE INVENTION

It is an object of the present invention to provide a hair-treatment cap which permits special effects for high fashion frosting, tipping, streaking, high-lighting, haloing, and the like, to be created in a simple and rapid manner.

It is another object of the present invention to provide a hair-treatment cap which prevents treating solution from bleeding through a lock of hair being treated and to the scalp area beneath the cap.

It is a still further object of the present invention to provide a hair-treating cap which permits various forms of frosting and contrasting to be made possible with natural hair colors of any color and shade.

It is yet another object of the present invention to provide a hair-treating cap which permits close control of the amount of hair treated.

Yet another object of the present invention is to provide a clamp specifically for use with a hair-treating cap according to the present invention which will permit close control of the amount of hair pulled through such a cap and will prevent bleeding of the treatment solution back through the hair to the scalp area of the person being treated.

These and other objects are achieved according to the present invention by provided a hair-treating cap having: a head cover arranged for completely covering the scalp of a wearer of the cap during hair treatment; and a suitable number of clamps, one or more, mounted on the head cover for engaging and holding hair to be treated.

The head cover preferably is provided with a plurality of openings, of a number corresponding to the number of clamps, for receiving the clamp in sealed relation with respect thereto, such that the head cover blocks the opening and is arranged for gripping a lock of hair to be treated. Alternatively, the clamps can be molded integrally with the head cover, which is preferably constructed from a sheet of a suitable flexible synthetic material in one or more sections, and has a raised rim around the front portion thereof to prevent treating solution from dripping into the face of a person whose hair is being treated.

A clamp, according to the invention, preferably includes a body provided with an aperture disposed for receiving a lock of hair through the associated opening provided in the head cover. A lock member is rotatably mounted on the body and provided with a through passage for accommodating the lock of hair received in the aperture of the body, with rotation of the lock member clampingly retaining the lock of hair relative to the body of the clamp.

More specifically, the body of a clamp according to the invention comprises a base member or portion in which the aperture is provided and a pair of codirectional and coextensive side walls extending in spaced relation from the base portion, with the aperture being disposed in the base portion between the side walls. Bearings in the form of suitable holes or recesses are provided in the side walls for journaling the lock member.

The lock member advantageously has a trunk portion arranged extending between the side walls of the body and provided with, or generally forming, the slot of the lock member, and terminating in a pair of trunnions journaled in the recesses of holes provided in the side walls. A handle portion extends longitudinally from and is affixed to the trunk portion and may actually support two sections of the trunk portion, for permitting rotation of the lock member about an axis passing through the trunnions in order to grip and release the lock of hair to be treated.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
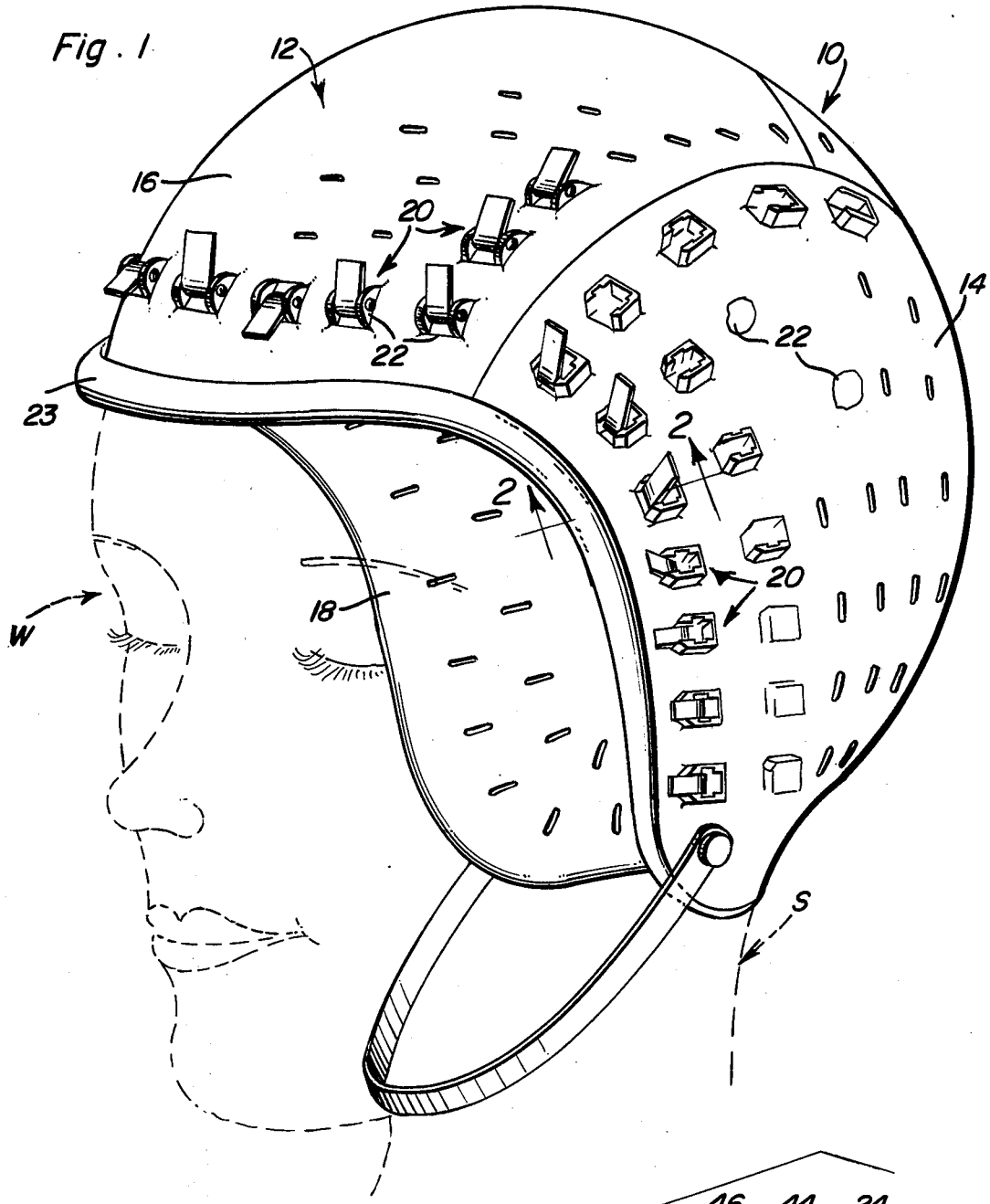
FIG. 1 is a schematic, perspective view showing a hair-treating cap according to the present invention disposed on the head of a person whose hair is to be treated.
Figure 6:
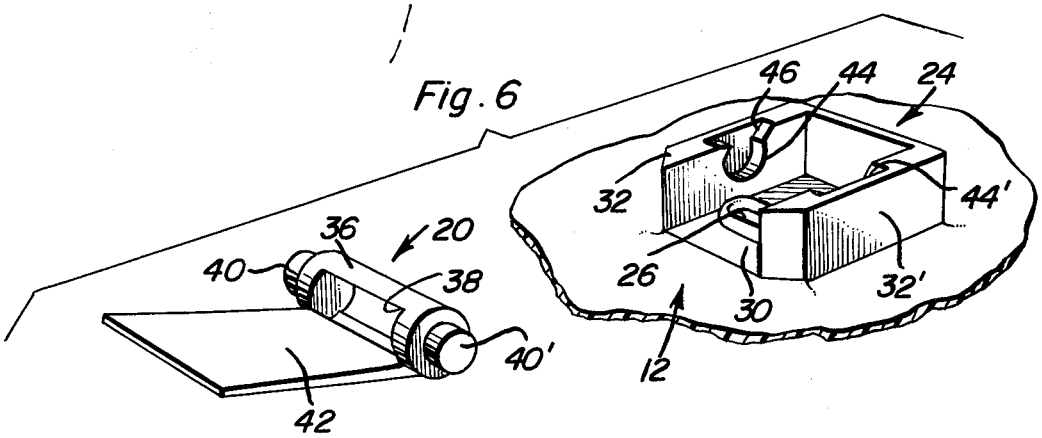
FIG. 6 is a fragmentary, exploded, perspective view showing the clamp as illustrated in FIGS. 2 through 5 in a disassembled mode for clarification.

Referring now more particularly to FIGS. 1 through 6 of the drawings, a hair-treating cap 10 according to the present invention includes a head cover 12 arrangeable completely covering a scalp S of a wearer W during hair treatments. Head Cover 12 can be constructed in the illustrated sections 14, 16, 18, and the like, or as a single piece, as desired, from a suitable flexible sheet material. Any synthetic or natural rubber or other suitable synthetic resin can be employed to construct cover 12, such as polyethylene, and the material preferably is transparent so that the operator (not shown) can see the relationship between the locks of hair being treated and the remainder of the hair on the scalp S of wearer W.

Disposed over the outer surface of cover 12 are shown a plurality of clamps 20 according to the present invention. These clamps 20, which are disposed for engaging and holding hair to be treated, can be arranged in openings 22 of sufficient size to receive a clamp 20, with the latter being mounted in sealed relation with respect to cover 12 so as to prevent leakage of treating solution through an opening 22. In this manner, the clamps 20 block the opening 22 and are in a position to grip a lock of hair to be treated.

Alternatively to the clamps 20 being mounted in sealed relation within openings 22, or over openings similar to those designated 22 but of smaller size, and being originally constructed as separate articles, the clamps 20 can also be molded integral with head cover 12 if so desired.

Head cover 12 is advantageously constructed, as mentioned above, from a flexible and pliable sheet material and is configured to conform to scalp S of wearer W. A raised portion advantageously forms a rim 23 around the forwardly disposed portion of head cover 12 so as to prevent the treating solution from dripping downwardly into the face and eyes of wearer W.

Each clamp 20 includes a body 24 provided with an aperture 26 having a raised peripheral rim and disposed in conformity with an associated one of the openings 22 for receiving a lock L of hair through opening 22. A lock member 28 is rotatably mounted on body 24 and provided with a through slot for receiving the lock L of hair received in aperture 26 of body 24. Rotation of lock member 28 retains lock L of hair relative to body 24 in a manner to be more fully described below.

Body 24 comprises a base portion 30 in which aperture 26 is provided, and a pair of codirectional and coextensive side walls 32 and 32′ extending in spaced relation with respect to one another from base portion 30, with aperture 26 being disposed between side walls 32 and 32′. A rear wall 34 extends from base portion 30 perpendicularly to and between side walls 32 and 32′ for cooperating with the latter to form a cavity in which lock member 28 is pivotally mounted. Bearings are provided on side walls 32 and 32′ for journaling lock member 28.

Lock member 28 comprises a generally elongated trunk portion 36 arranged extending between side walls 32 and 32′ and forming a passage 38 which receives a lock L of hair from aperture 26, and which terminates in a pair of oppositely directed trunnions 40 and 40′ journaled on side walls 32 and 32′. A handle portion 42 extends longitudinally from and is affixed to trunk portion 36 for rotating the lock member 28 about an axis passing through trunnions 40 and 40′.

In clamp 20, recesses 44 and 44′ are formed opening in opposed relation to one another on the inner surfaces of side walls 32 and 32′ for receiving trunnions 40 and 40′. Necks 46 formed in recesses 44 and 44′ permit trunnions 40 and 40′ to be snapped into the recesses 44, 44′, with it being understood that the material from which body 24 and lock member 28 are constructed is sufficiently flexible to permit such snap insertion. Clamp 20 may be constructed from the same material as head cover 12, if desired.

Figure 7:
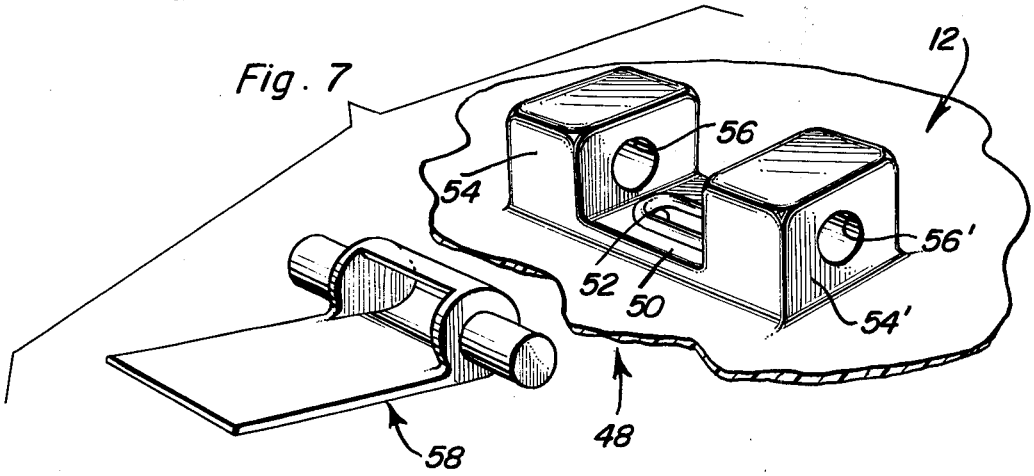
FIG. 7 is a fragmentary, exploded, perspective view, similar to FIG. 6, but showing a second embodiment of a clamp according to the present invention.

Referring now more particularly to FIG. 7 of the drawings, a clamp 48 is illustrated which includes a base portion 50 provided with an aperture 52 and having extending from longitudinally spaced ends a pair of codirectionally extending side walls 54 and 54′ provided with respective through holes 56 and 56′ for receiving the trunnions of a lock member 58 which is substantially identical in construction to lock member 28. It will be understood that insertion of the trunnions of lock member 58 into holes 56 and 56′ can be achieved by bending clamp 48, or more specifically base portion 50, about the axis of symmetry of the clamp 48 which is perpendicular to the axis of rotation formed by the line extending through the center of the holes 56 and 56′.

Figure 8:
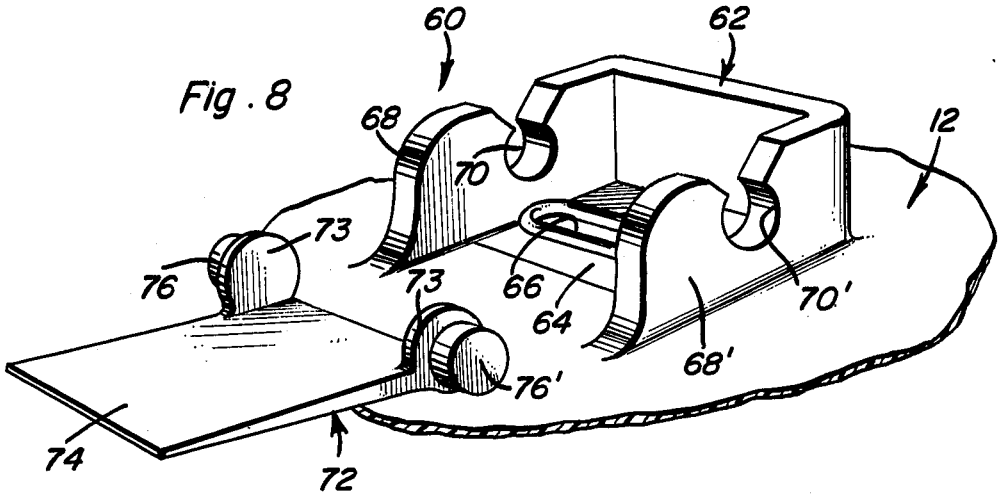
FIG. 8 is a fragmentary, exploded, perspective view, similar to FIGS. 6 and 7, but showing a third embodiment of a clamp according to the present invention.
Figure 9:
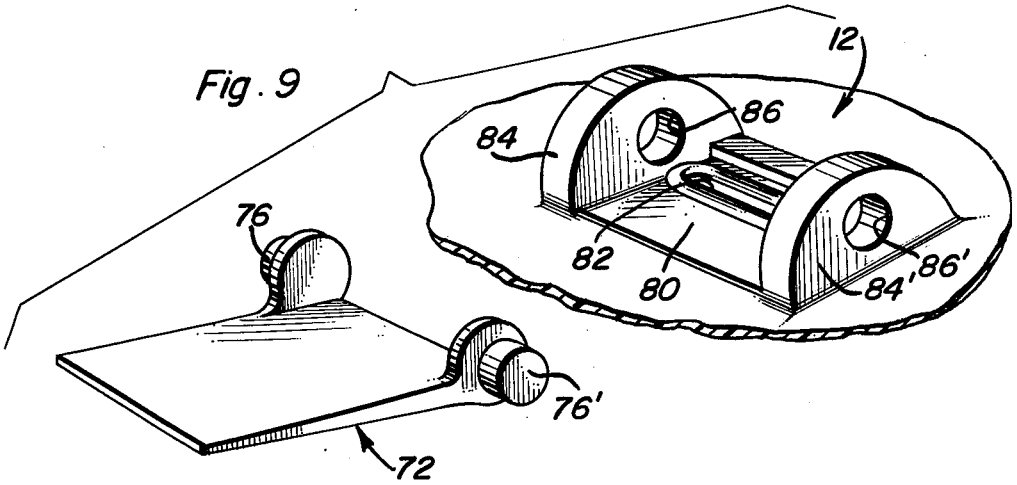
FIG. 9 is a fragmentary, exploded, perspective view, similar to FIGS. 6, 7, and 8, but showing a fourth embodiment of a clamp according to the present invention.
Figure 10:
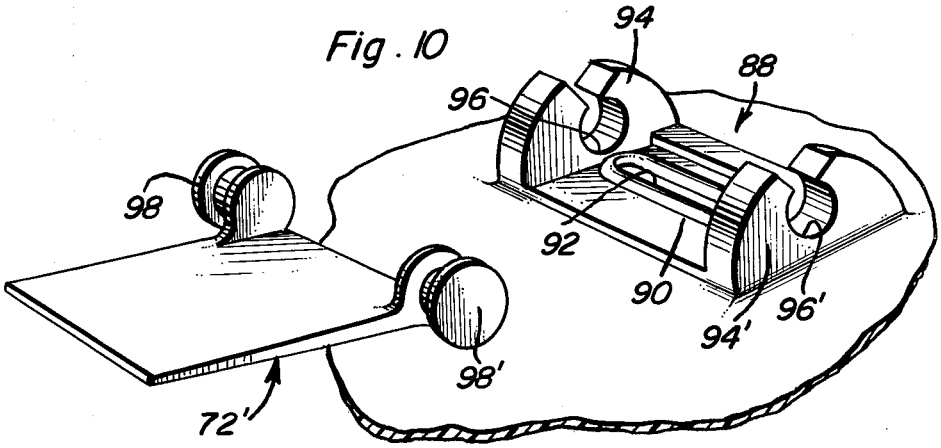
FIG. 10 is a fragmentary, exploded, perspective view, similar to FIGS. 6, 7, 8 and 9, but showing yet another embodiment of a clamp according to the present invention.

FIGS. 8, 9 and 10 show still further embodiments of clamps according to the present invention. In FIG. 8, a clamp 60 includes a body 62 having a base portion 64 provided with an aperture 66 and bracketed by side walls 68 and 68′ in which are provided recesses 70 and 70′ similar to recesses 44 and 44′ but illustrated as extending entirely through side walls 68 and 68′. A lock member 72 has a trunk portion partly formed by a base section of a handle portion 74 and includes ears 73 supporting respective trunnions 76 and 76′ which are insertable into recesses 70 and 70′ for rotation with respect to body 62.

A clamp 78 is illustrated in FIG. 9 as including a base portion 80 provided with an aperture 82 and having extending therefrom so as to bracket aperture 82 a pair of codirectional side walls 84 and 84′ provided with through holes 86 and 86′. The lock member 72 is illustrated as being employed in conjunction with the body of this form of the invention, with it being understood that insertion of the trunnions 76, 76′ of lock member 72 into the holes 86 and 86′ can be achieved by a bending operation as described above in conjunction with clamp 48 disclosed in FIG. 7.

FIG. 10 shows a clamp 88 including a base portion 90 provided with an aperture 92 bracketed by side walls 94 and 94' extending codirectionally from base portion 90. Side walls 94 and 94' are provided with recesses 96 and 96' similar to the recesses 70 and 70' which receive trunnions 98 and 98' of a lock member 72' similar to lock member 72 but having the modified trunnions 98 and 98'. The latter help prevent side sway of lock member 72' with respect to the side walls 94 and 94'.

Figure 2:
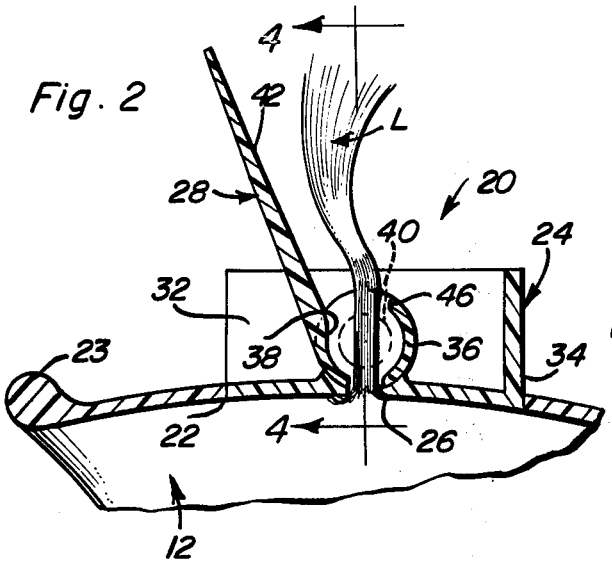
FIG. 2 is an enlarged, fragmentary, sectional view taken generally along the line 2—2 of FIG. 1.
Figure 3:
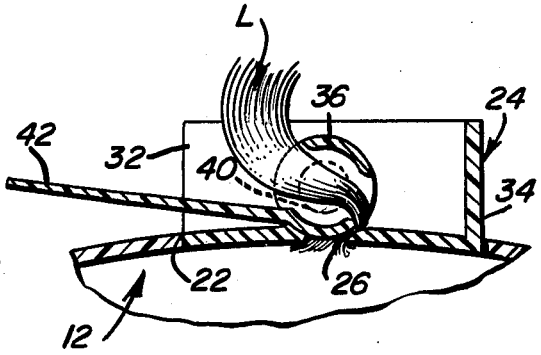
FIG. 3 is a fragmentary, sectional view similar to FIG. 2, but showing a clamp according to the invention in a hair-gripping mode.
Figure 4:
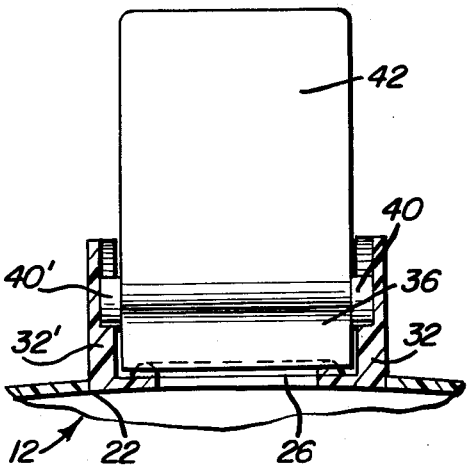
FIG. 4 is a fragmentary, sectional view taken generally along the line 4—4 of FIG. 2.
Figure 5:
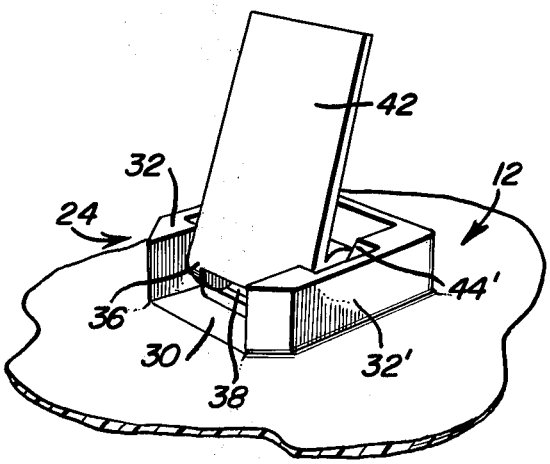
FIG. 5 is a fragmentary, perspective view showing a clamp as illustrated in FIGS. 2 through 4.

As can be appreciated from the above description and from the drawings, any of the disclosed clamps 20, 48, 60, 78, and 88, according to the invention, operate in a similar manner inasmuch as a lock L of hair is passed through the opening provided in the head cover, the aperture provided in the base portion of the clamp body, and through the associated passage either positively provided in the trunk portion of the clamp, as passage 38, or effectively formed by a bracket structure as in the case of the lock members 72 and 72'. With reference to FIGS. 2 and 3 of the drawings, once the lock L is thus arranged within the clamp, pivotal movement of the handle portion, 42 in this case, counterclockwise, as seen in FIGS. 2 and 3, will positively grip lock L, without causing damage either to the hair or to the scalp. Further, a section either of the trunk portion or of the handle portion functioning as a support for trunk portions, will effectively seal the aperture provided in the base portion of the clamp so as to prevent the treating solution from bleeding beneath the head cover and onto the hair and scalp therebelow.

As can be readily understood from the above description and from the drawings, a hair-treating cap, according to the present invention, allows creation of various forms of frosting and contrasting with any natural hair color whether the person being treated is a blonde, a dark haired, red head, or any other shade or hue, because of the amount of hair pulled through the head cover and locked can be controlled, while the lock of hair is retained close to the scalp without the possibility of the bleach or other suitable treating solution, known per se, bleeding to the scalp.

A crochet hook or similar appliance (not shown) can be employed to pull the hair through the clamp.

A hair-treating clamp according to the invention can be used for retouching, reverse frosting, and other similar operations, and gives the operator precise control. All of the openings provided in the head cover can be used, or any number less than the total, to achieve the desired effect. The process can be visible at all times by making the head cover from a clear material, and a clear plastic wrap can be placed on top of the cap itself once bleach, or other suitable treating material, has been applied to the hair and the person whose hair is being treated then placed under a dryer (not shown) or other suitable appliance so as to apply heat to the hair and speed up the bleaching process.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A hair-treating cap for covering a scalp during hair treatments, comprising, in combination:

(a) head cover means for completely covering a scalp of a wearer during hair treatments; and (b) clamp means mounted on the head cover means for engaging and holding hair to be treated, and preventing treating solution from bleeding through the head cover means and to the scalp of the wearer, wherein the clamp means includes, in combination:

(1) a clamp body provided with an aperture disposed for receiving a lock of hair of said wearer to be treated; and (2) a lock member rotatably mounted on the clamp body and provided with a passage for receiving the lock of hair received in the aperture of the clamp body, rotation of the lock member retaining the lock of hair relative to the clamp body, and simultaneously blocking the aperture provided in the clamp body.

2. A structure as defined in claim 1, wherein the lock member comprises a trunk portion at least partially forming the passage provided in the lock member, a pair of oppositely directed trunnions mounted on the trunk portion and journaled on the body of the clamp, and a handle portion arranged extending longitudinally from and affixed to the trunk portion for rotating the lock member about an axis passing through the oppositely directed trunnions.

3. A structure as defined in claim 1, wherein the clamp body comprises a base portion in which the aperture is provided, and a pair of codirectional and coextensive side walls extending in spaced relation from the base portion, the aperture being disposed between the side walls, and bearing means provided on the side walls for journaling the lock member for rotation relative to the clamp body.

4. A structure as defined in claim 3, wherein the lock member comprises a trunk portion arranged between the side walls of the body and forming the passage provided in the lock member, a pair of trunnions extending codirectionally from the trunk portion and journaled on the side walls of the clamp body, with a handle portion extending longitudinally from and affixed to the trunk portion for rotating the lock member about an axis passing through the oppositely directed trunnions, the trunk portion blocking the aperture when in a hair retaining mode.

5. A structure as defined in claim 1, wherein the head cover means is provided with a plurality of openings spaced thereover, the head cover means being constructed from a flexible, sheet material configured to conform to the scalp of the wearer, the clamp means including a plurality of clamp bodies associated with the openings, one of the clamp bodies for each of the openings, the clamp bodies being mounted in sealed relationship on the head cover means and blocking the openings provided in the head cover means.

6. A structure as defined in claim 5, wherein the body of the clamp comprises a base portion in which the aperture is provided, and a pair of codirectional and coextensive side walls extending in spaced relation from the base portion, the aperture being disposed between the side walls, and bearing means provided on the side walls for journaling the lock member for rotation relative to the body.

7. The structure as defined in claim 5 wherein said head cover means comprises a plurality of sections sealed together, the head cover means having rim to prevent treating solution from dripping downwardly onto the face and eyes of said wearer.

8. A structure as defined in claim 6, wherein the lock member comprises a trunk portion arranged between the side walls of the body and forming the passage provided in the lock member, a pair of trunnions extending codirectionally from the trunk portion and journaled on the side walls of the body of the clamp, with a handle portion extending longitudinally from and affixed to the trunk portion for rotating the lock member about an axis passing through the oppositely directed trunnions, the trunk portion blocking the aperture when in a hair retaining mode.

9. The structure as defined in claim 7 wherein the number of said sections is four.

10. A lock for gripping locks of hair to be treated, comprising, in combination:

(a) a clamp body provided with an aperture disposed for receiving a lock of hair to be treated; and (b) a lock member rotatably mounted on the clamp body and provided with a passage arranged for receiving the lock of hair through the aperture of the clamp body, rotation of the lock member retaining the lock of hair relative to the clamp body, and simultaneously blocking the aperture provided in the clamp body, wherein the clamp body comprises a base portion in which the aperture is provided, and a pair of codirectional and coextensive side walls extending in spaced relation from the base portion, the aperture being disposed between the side walls, and bearing means provided on the side walls for journaling the lock member for rotation relative to the body.

11. A structure as defined in claim 10, wherein the lock member comprises a trunk portion arranged between the side walls of the clamp body and forming the passage provided in the lock member, a pair of trunnions extending codirectionally from the trunk portion and journaled on the side walls of the clamp body, with a handle portion extending longitudinally from and affixed to the trunk portion for rotating the lock member about an axis passing through the oppositely directed trunnions, the trunk portion blocking the aperture when in a hair retaining mode.

* * * * *